US007097521B1

(12) United States Patent
Papadakis

(10) Patent No.: US 7,097,521 B1
(45) Date of Patent: Aug. 29, 2006

(54) SELF-PROPELLED SURFBOARD

(76) Inventor: George Papadakis, 3348 Plaza Way, Salt Lake City, UT (US) 84109

( * ) Notice: Subject to any disclaimer, the term of this patent is extended or adjusted under 35 U.S.C. 154(b) by 0 days.

(21) Appl. No.: 11/123,938

(22) Filed: May 6, 2005

(51) Int. Cl.
*B63H 16/20* (2006.01)

(52) U.S. Cl. ..... 440/31

(58) Field of Classification Search ..... 440/21, 440/26, 27, 29, 30, 31, 32, 90; 441/65, 129, 441/130
See application file for complete search history.

(56) References Cited

U.S. PATENT DOCUMENTS

| | | | | |
|---|---|---|---|---|
| 839,672 | A * | 12/1906 | Stub | 440/31 |
| 1,186,413 | A * | 6/1916 | Merrill | 440/31 |
| 1,277,022 | A * | 8/1918 | Young | 440/31 |
| 1,393,117 | A * | 10/1921 | Halfpenny | 440/31 |
| 1,683,058 | A * | 9/1928 | Uberto | 440/31 |
| 1,752,051 | A * | 3/1930 | Young | 440/31 |
| 3,714,921 | A | 2/1973 | Gibson | |
| 4,321,048 | A * | 3/1982 | Marchese et al. | 440/32 |
| 4,500,297 | A | 2/1985 | Boulva | |
| D299,941 | S | 2/1989 | Chang | |
| 5,110,313 | A | 5/1992 | Po | |
| 5,643,020 | A * | 7/1997 | Harris | 440/31 |
| 5,989,081 | A | 11/1999 | Lekhtman | |
| 6,257,944 | B1 | 7/2001 | Herrod | |

* cited by examiner

*Primary Examiner*—Lars A. Olson
(74) *Attorney, Agent, or Firm*—Lawrence J. Gibney, Jr.

(57) ABSTRACT

This device allows a user to propel a surfboard in the water. The device also allows the individual to steer and navigate the device.

15 Claims, 9 Drawing Sheets

SELF-PROPELLED SURFBOARD

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This relates to recreational equipment and specifically related to water sports. This device allows an individual to lay on a surfboard and propel and steer it through the water.

B. Prior Art

There are many other references to recreational equipment, and in particular, recreational equipment related to water. An example of this is Lekhtman, U.S. Pat. No. 5,989,081, which is a pedal boat. This particular device teaches a means of propulsion by operation of foot cranks, as well as a steering assembly. This does not allow an individual to lie on his stomach to navigate.

Another example is Gibson, U.S. Pat. No. 3,714,921, which is a water float with rear panel portions. Another device is Chang, D299,941, which is a design patent for a paddle wheel propelled watercraft. Another device is Herrod, U.S. Pat. No. 6,257,944, which is a paddle board. Herrod does not teach a propulsion mechanism under the water.

BRIEF SUMMARY OF THE INVENTION

This device is a piece of recreational sporting equipment. The individual user lies flat on the top surface and extends his legs to a set of foot pedals, which are beneath the surface of the water. As the user rotates the foot pedals a means of propulsion under the surface of the water is activated.

Shoulder restraints are provided to position the user of the equipment in the appropriate posture on the top surface. A crotch restraint is at the opposite end of the shoulder harnesses to maintain the proper position of the user of this device. Appropriate padding has been added on the top surface to increase the comfort for the user.

The individual places his or her feet on a set of foot pedals, which are below the surface of the water. The foot pedals are connected to a mechanism, which provides propulsion for the device. As the individual turns the foot pedals, the means of propulsion provides the ability to move the device in the water. Appropriate mechanical linkage between the foot pedals and the means of propulsion is provided.

In order to accommodate different sized individuals, the foot pedals are housed in a set of arms, which telescope to enable different sized individuals to use this device. Additionally, the shoulder restraints and crotch restraint are also adjustable to accommodate different body types.

In an alternative embodiment two handles are provided, which control a rudder blade towards the rear of the device in order to provide direction and to enable the user to steer this device. The handles may be retractable and may fold.

This device should be made from buoyant material that should also be durable and non-corrosive because of the exposure to the water. In order to avoid damage to the propulsion mechanism, a shroud is provided to protect that portion of the device.

Different means of propulsion may be used, including but not limited to, a propeller or water screw. As stated before, handles may be provided, which are connected to a rudder blade to be able to steer the device as an individual propels it.

REFERENCE TO NUMBERS

Figure 1:
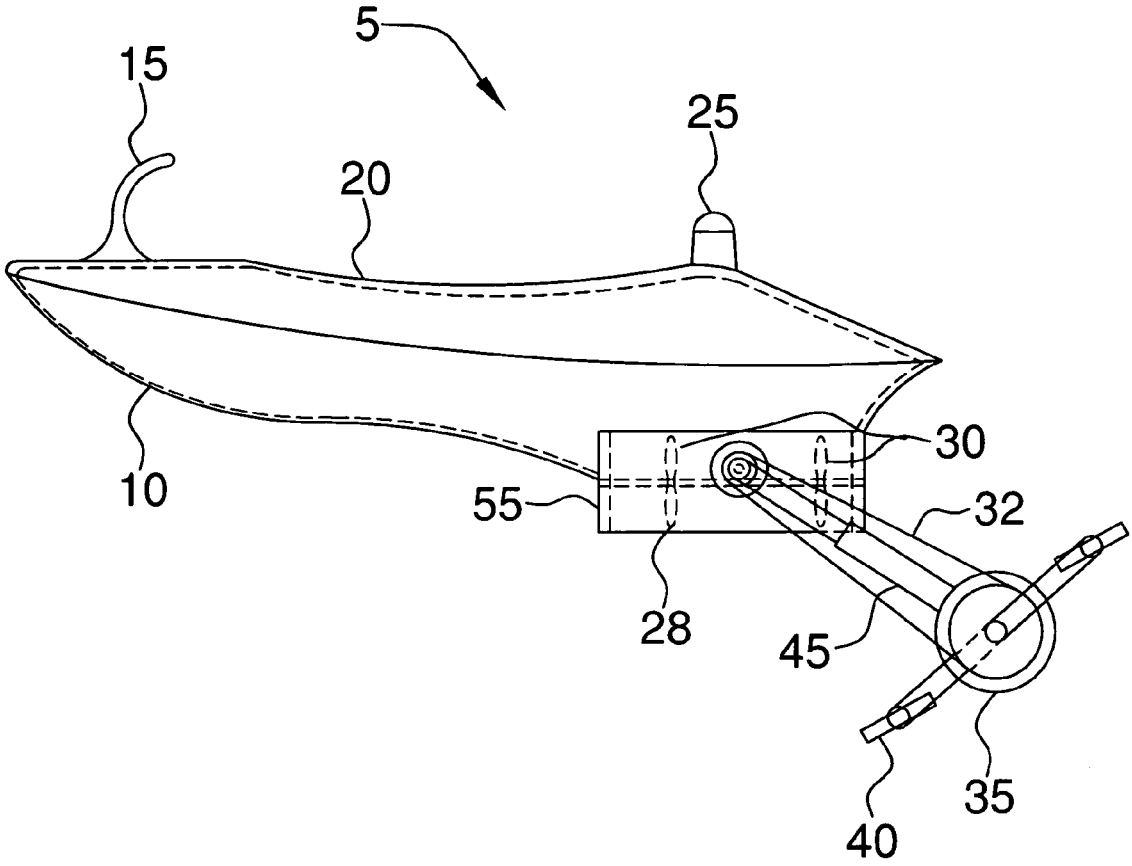
FIG. 1 is a left side view of the device.
Figure 2:
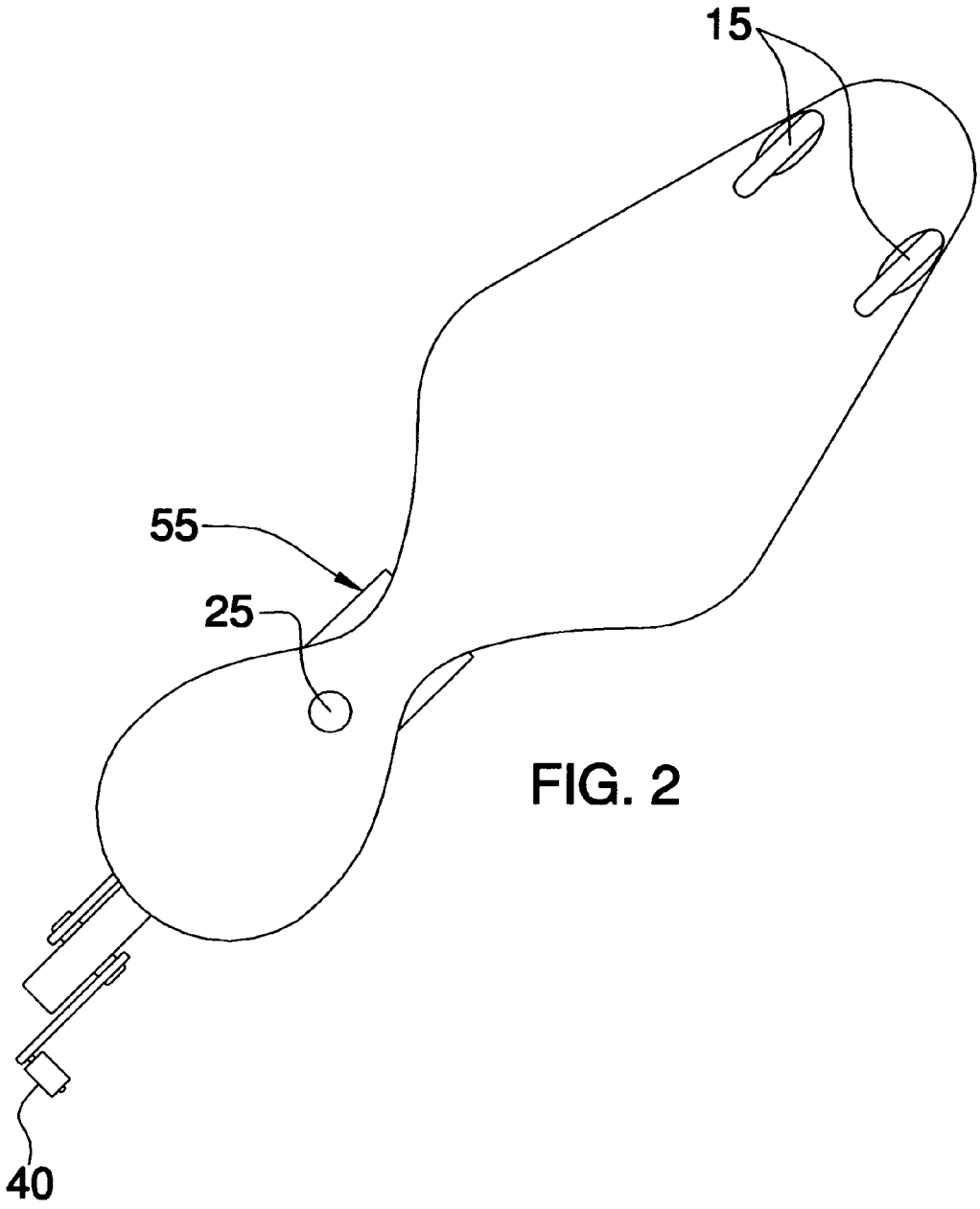
FIG. 2 is a top view of the device.

5 Device
10 Hull
15 Shoulder restraint
20 Top surface
25 Crotch restraint
28 Single screw
30 Dual screws
32 Pulley
35 Crank
40 Foot pedals
45 Telescoping arm
55 Shroud
56 Means to secure the propeller(s) within the shroud
60 Handles
65 Rudder
70 Stanchion
75 Pulley cord
80 Connecting rod
85 Gear mechanism

DETAILED DESCRIPTION OF THE EMBODIMENTS

This device 5 is made in one piece. It has a top surface 20, which is padded and a hull or bottom surface 10, which is placed in the water. The user of this device will rest chest down and position his or her body between the shoulder restraints 15 and the crotch restraint 25. FIG. 1, 6

A set of shoulder restraints 15 are placed at one end and a crotch restraint 25 is placed at the other end on the top surface 20 to properly align the individual. Both the shoulder restraints 15 and the crotch restraint 25 are adjustable to maximize the comfort of the user. Padding is provided on the top surface 20 for the additional comfort of the user.

Figure 3:
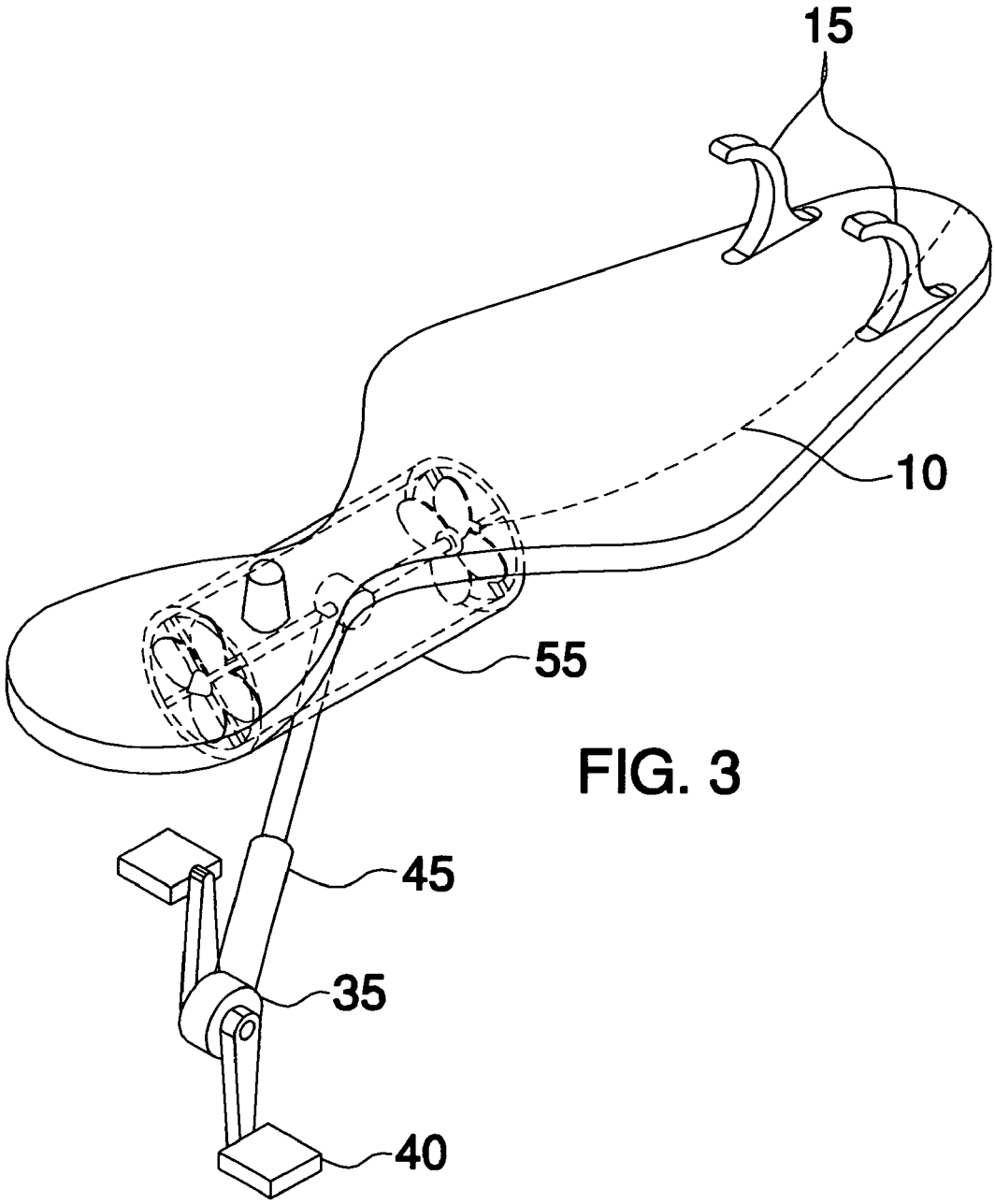
FIG. 3 is an isometric view of the device.

A propulsion mechanism for this device is provided and is located below the surface of the water. The propulsion mechanism may consist-of a single propeller 28 or a series of propellers 30 or a water screw 25 as shown in FIGS. 1, 3, 4, 5, and 7. The propulsion mechanism is protected by a shroud 55 to prevent damage. FIGS. 1, 3 A means to mount 56 the means of propulsion within the shroud is provided.

Figure 4:
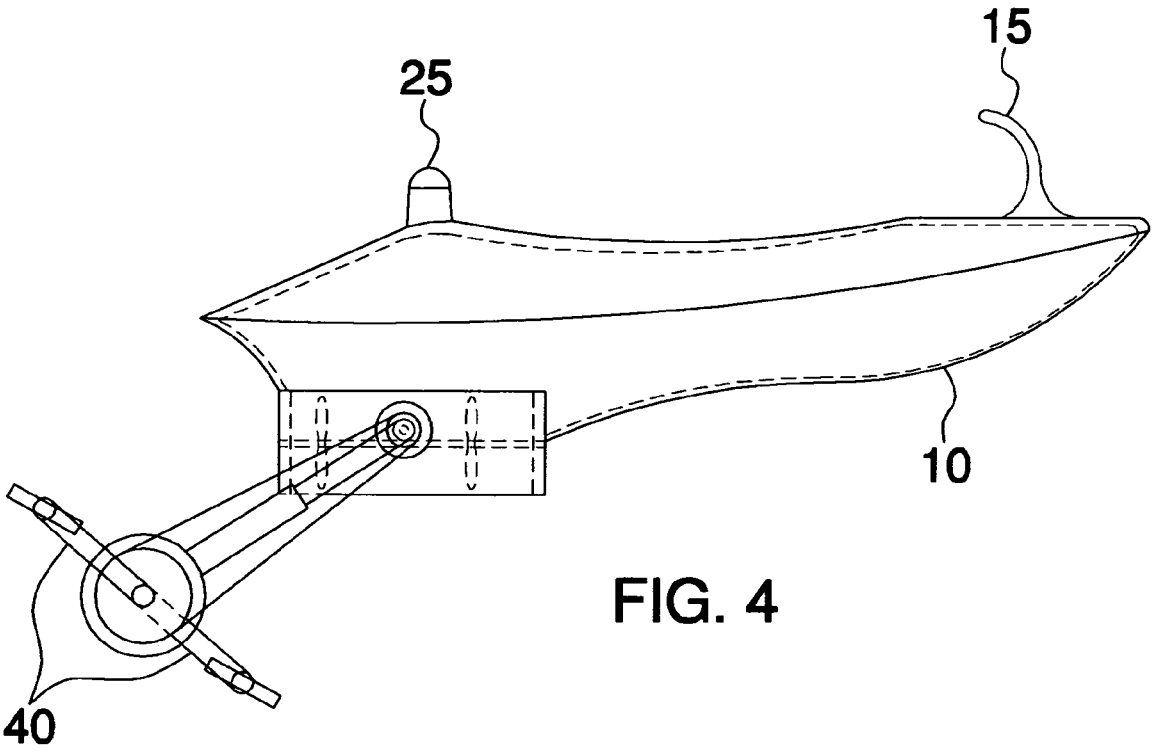
FIG. 4 is a right side view of the device.
Figure 5:
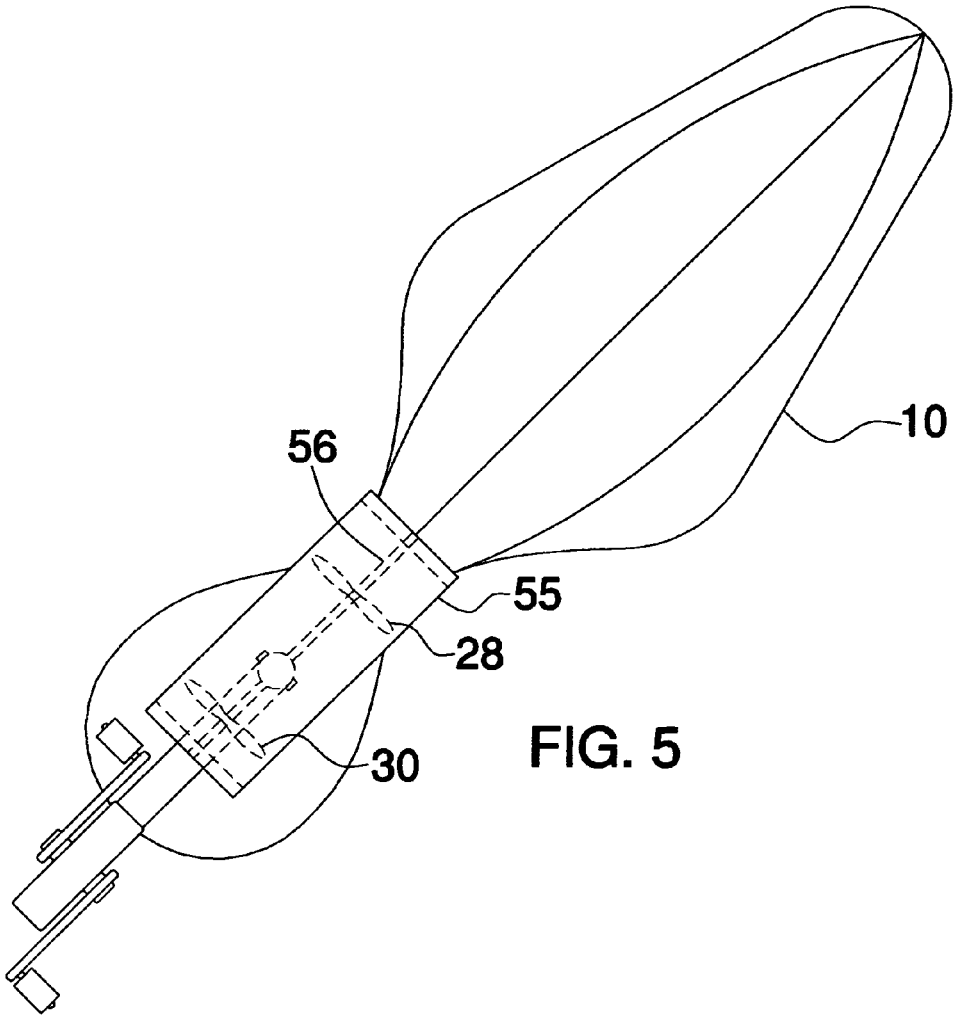
FIG. 5 is a bottom view of the device.
Figure 6:
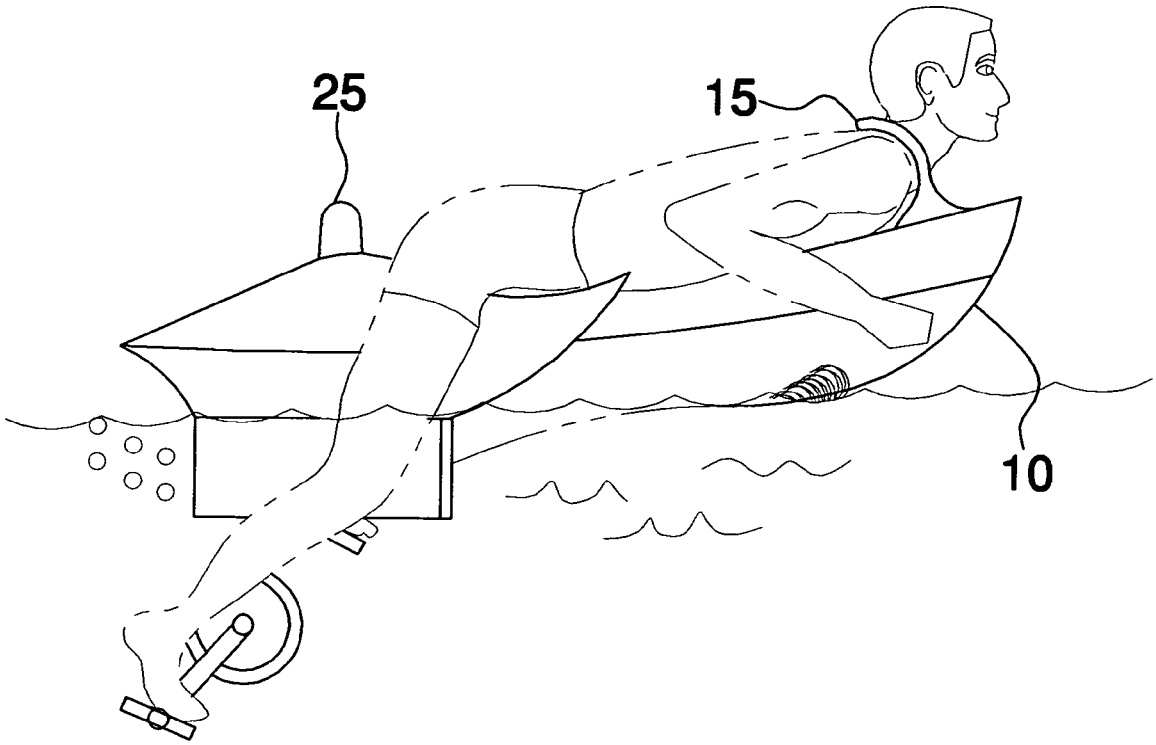
FIG. 6 is a view of the first embodiment in use.
Figure 7:
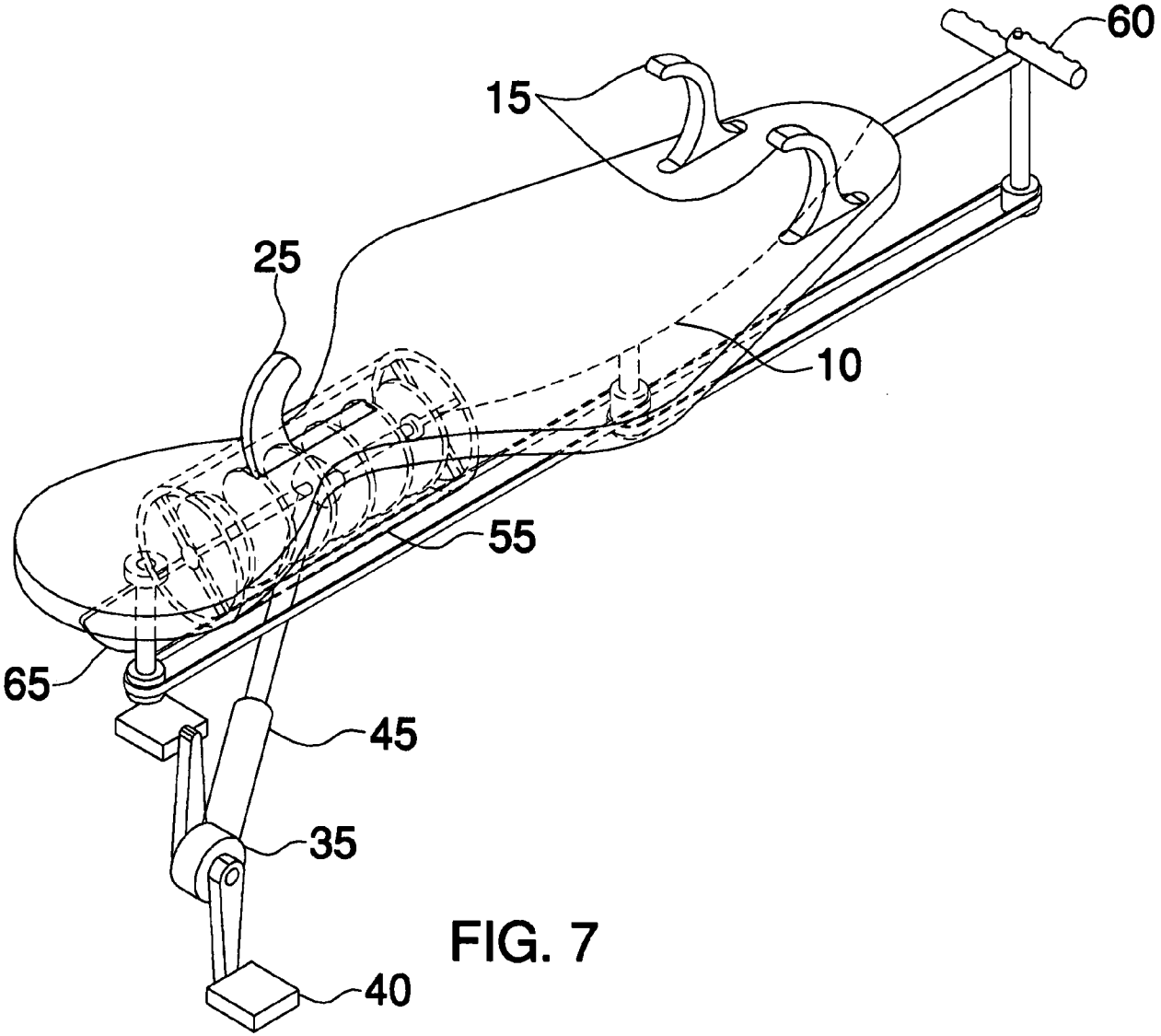
FIG. 7 is an isometric view of the alternative embodiment.

In order to use the device an individual must be able to pedal in order to provide propulsion. The propulsion is provided by two foot pedals 40, which are also located beneath the surface of the water. FIGS. 3,4,6 The foot pedals 40, are connected to a crank 35, which in turn is connected to the propulsion mechanism. FIG. 1 A means to connect the crank 35 to the propulsion mechanism is provided. This may be accomplished by using an elastic external pulley such as depicted in FIG. 1 or may be accomplished with an internal gear mechanism (not drawn) in a housing such as shown in FIG. 3. The foot pedals 40 rest on one end of a telescoping arm 45. This telescoping arm 45 may be self adjusting or may be adjusted by the application of pressure from the feet of the user to accommodate various sized individuals.

As the user turns the foot pedals 40 the device 5 is propelled through the water.

ALTERNATIVE EMBODIMENT

Figure 8:
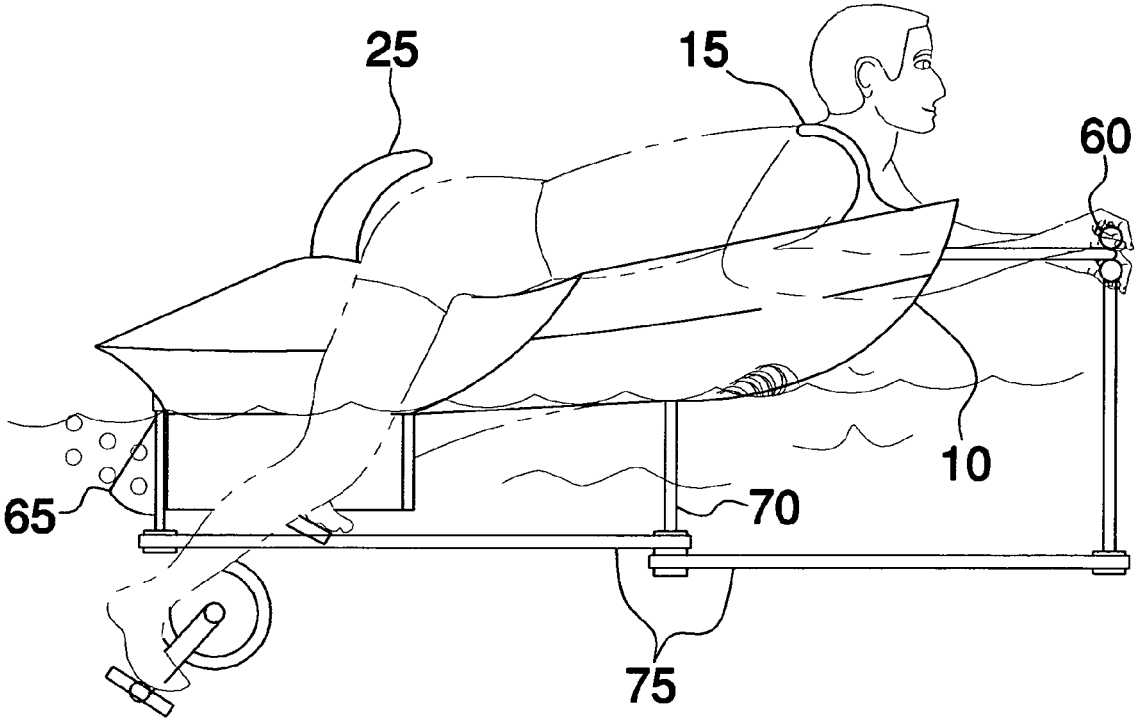
FIG. 8 is a side view of the alternative embodiment in use.
Figure 9:
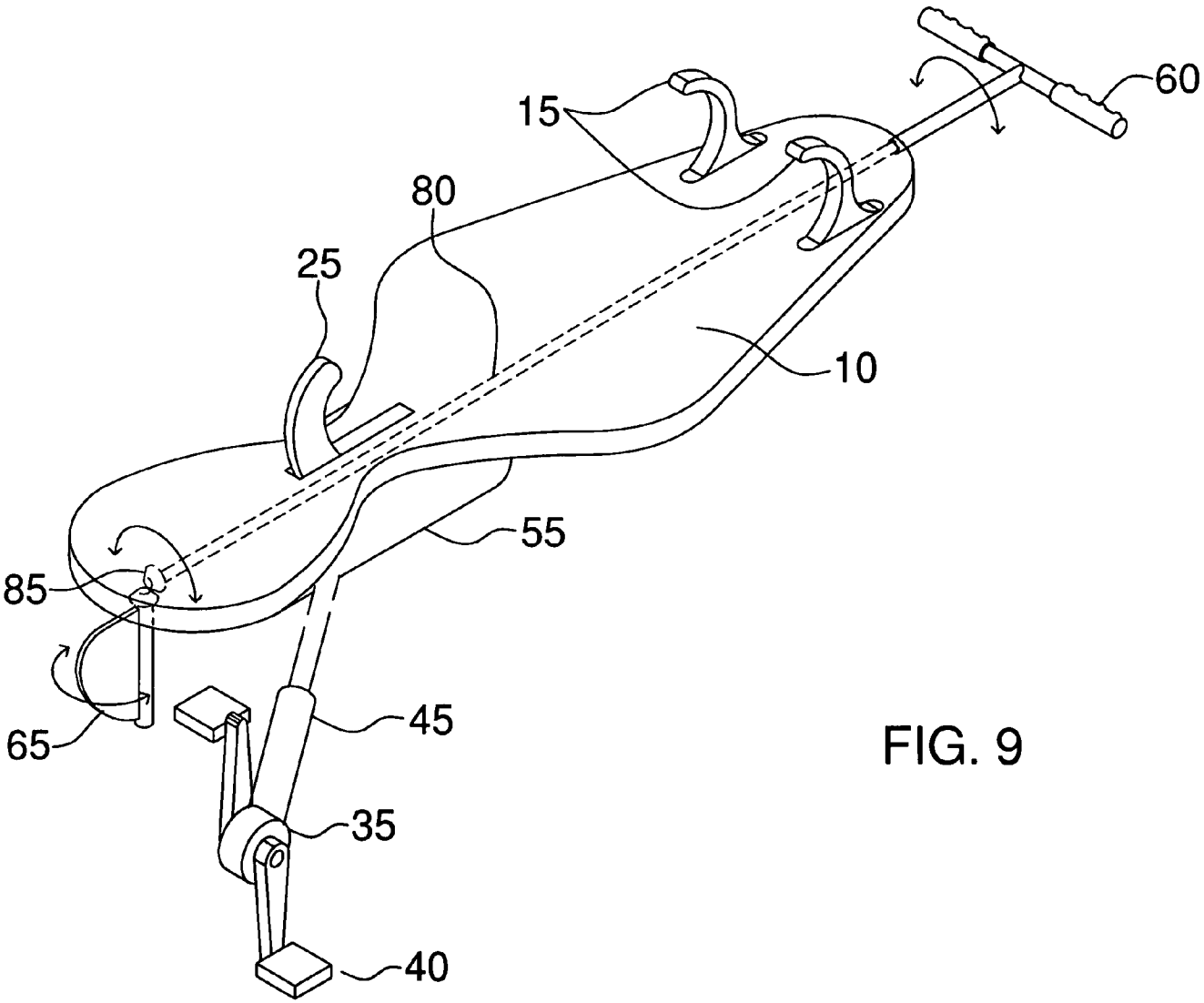
FIG. 9 is an isometric view of the alternative embodiment illustrating a different means to control the rudder.

An alternative embodiment employs a set of steering handles 60. The steering handles 60 would allow the individual to steer the device. The steering handles 60 are connected to a rudder blade 65 which would act as a rudder. The linkage between the handle 60 and the rudder blade 65 may be accomplished by a support stanchion 70 and a series of elastic cords 75 or by a connecting rod 80 and a gear mechanism 85. FIG. 8, 9

The steering arms 60 may fold and may be retractable. The steering arms 60 with folding handles can be retractable as well as telescoping in order to accommodate different sized individuals.

Because of the proximity to water it will be preferable to construct this device from plastic as much as possible.

Because of the need for buoyancy appropriate material should be used to address that concern. Additionally, for the comfort of the user, there should be a padded area 20 on the top surface. Many different types of padding may be used, although they should be water resistant.

The invention claimed is:

1. A piece of recreational equipment to be used in the water which is comprised of the following:

a. single piece which has a top surface and a bottom surface;
b. shoulder restraints;
c. crotch restraint;
d. shroud;
e. crank;
f. foot pedals;
g. means of propulsion;
h. means to engage the means of propulsion;
wherein the bottom surface rests in the water;
wherein an individual user lies chest down on the top surface;
wherein the body of a person is positioned between the shoulder restraint and crotch restraint respectively;
wherein the shoulder restraint is adjustable;
wherein the crotch restraint is adjustable;
wherein the crank is housed in a telescoping arm;
said crank is connected to the foot pedals;
wherein the individual turns the foot pedals which engages the means of propulsion;
wherein a shroud covers the means of propulsion;
wherein a means to mount the means of propulsion within the shroud is provided;
wherein a means to engage the means of propulsion is provided.

2. The means of propulsion as described in claim 1 is a single propeller.

3. The means of propulsion as described in claim 1 is a plurality of propellers.

4. The means of propulsion as described in claim 1 is a water screw.

5. The device as described in claim 1 wherein the means to engage the means of propulsion is a pulley.

6. The means of propulsion as described in claim 5 is a single propeller.

7. The means of propulsion as described in claim 5 is a plurality of propellers.

8. The means of propulsion as described in claim 5 is a water screw.

9. The device as described in claim 1 wherein the means to engage the means of propulsion as is an internal gear mechanism.

10. A piece of recreational equipment to be used in the water which is comprised of the following:

a. single piece which has a top surface and a bottom surface;
b. shoulder restraints;
c. crotch restraint;
d. shroud;
e. crank;
f. foot pedals;
g. means of propulsion;
h. means to engage the means of propulsion;
i. handles;
j. rudder;
k. means to steer;
wherein the bottom surface rests in the water;
wherein an individual user lies chest down on the top surface;
wherein the body of a person is positioned between the shoulder restraint and crotch restraint respectively;
wherein the shoulder restraint is adjustable;
wherein the crotch restraint is adjustable;
wherein the crank is housed in a telescoping arm;
said crank is connected to the foot pedals;
wherein the individual turns the foot pedals which engage the means of propulsion;
wherein a shroud covers the means of propulsion;
wherein a means to mount the means of propulsion within the shroud is provided;
wherein a means to engage the method of propulsion is provided;
wherein handles are provided to direct the movement of the rudder;
wherein a means to steer is provided.

11. The device as described in claim 10 wherein the means to engage the means of propulsion is a pulley.

12. The means to engage the means of propulsion as described in claim 10 is an internal gear mechanism.

13. The device as described in claim 10 wherein the means to steer is a series of pulleys with elastic cords.

14. The device as described in claim 10 wherein the means to steer is a connecting rod and gear assembly.

15. The device as described in claim 10 wherein the handles are retractable.

* * * * *